United States Patent [19]

Jones

[11] Patent Number: 4,488,466

[45] Date of Patent: Dec. 18, 1984

[54] APPARATUS FOR CUTTING SHEET MATERIAL

[75] Inventor: William C. Jones, East Sandwich, Mass.

[73] Assignee: Seal Tech Corp., Wareham, Mass.

[21] Appl. No.: 414,977

[22] Filed: Sep. 7, 1982

[51] Int. Cl.[3] ..... B26D 7/14

[52] U.S. Cl. ..... 83/175; 83/18; 83/649; 83/386; 225/105

[58] Field of Search ..... 83/175, 18, 649, 382, 83/386; 225/95, 105

[56] References Cited

U.S. PATENT DOCUMENTS

| | | | |
|---|---|---|---|
| 3,533,616 | 10/1970 | Bettenhausen | 83/175 X |
| 3,794,228 | 2/1974 | Colwill et al. | 225/105 X |
| 4,130,038 | 12/1978 | Zehnder | 83/175 |
| 4,196,647 | 4/1980 | Fish | 83/175 |
| 4,417,495 | 11/1983 | Gordon et al. | 83/175 |

*Primary Examiner*—Donald R. Schran
*Attorney, Agent, or Firm*—Richard P. Crowley

[57] ABSTRACT

An apparatus for and a method of dispensing cut sheet material, particularly foam sheet material, which comprises a first fixed pair of sheet-retainer bars, and a second, movable pair of sheet-retainer bars and a cutting knife, the second pair of retainer bars and the cutting knife adapted to move with a reciprocating piston, and a control means, so that the sheet material is moved sequentially between the first and second retainer bars while being dispensed from a supply roll, the sheet retained under tension between the first and second retainer bars and the sheet, while under tension, severed by the cutting knife which passes into an air space between the first pair of sheet-retainer bars, thereby providing for rapid, effective and efficient means for the dispensing and cutting of sheet material to defined lengths.

13 Claims, 9 Drawing Figures

APPARATUS FOR CUTTING SHEET MATERIAL

BACKGROUND OF THE INVENTION

There are many devices for the dispensing and cutting of sheet or film-type material to a desired cut length. For example, U.S. Pat. No. 3,574,039 describes a film-sealing and film-cutting apparatus for sealing and cutting plastic film, wherein a sealing bar comes into pressure contact with two layers of plastic film retained by a hold-down bar, and a hot ribbon cutter moves in a reciprocating manner to sever the parallel sealed surfaces. U.S. Pat. No. 3,122,292 discloses a web-feeding and web-severing device for thin-film plastic material, wherein a reciprocating cutting knife moves to sever the web material, while the web material is gripped along its side edges. U.S. Pat. No. 3,384,528 employs a pair of clamping jaws, one jaw being fixed, and a fixed knife for the severing and welding of a thermoplastic tubing film. Other film-sealing and film-cutting apparatuses of the prior art are described, for example, in U.S. Pat. Nos. 3,321,353 and 3,863,821.

Despite the numerous devices used for the dispensing and cutting of film material, there still exists a need for an apparatus and a method of cutting and dispensing sheet material, particularly relatively thick foam sheet material, to desired lengths, which device is simple in design, is easily manufactured and operated, is inexpensive and which provides for rapid, effective and accurate cutting of the sheet material in a continuous manner to desired lengths.

SUMMARY OF THE INVENTION

The present invention is directed to an apparatus for and a method of dispensing and cutting sheet material to a desired length. In particular, the invention concerns an apparatus for and a method of dispensing foam sheet material and cutting the foam sheet material in an accurate, careful and continuous manner to desired lengths.

The cutting and dispensing apparatus of the invention comprises a means to support a roll of sheet material, such as foam sheet material, which is desired to be dispensed and cut to a desired length by the apparatus. Typically, the sheet material to be dispensed and cut may comprise, but is not limited to, any sheet material, particularly in continuous roll form, such as paper, thermoplastic film, such as polyethylene, polypropylene, cellulose, and even fluorocarbon films, such as Teflon and similar tough sheet materials which are difficult to dispense and cut in an accurate and rapid manner. More particularly, the present apparatus is useful in the dispensing and cutting of relatively thick foam sheet material, such as air-bubble wrap sheet material and expanded, flexible, thermoplastic foam sheet material; for example, having a thickness of 1/32nd to ½ths of an inch in thickness, which foam-type material is difficult to cut accurately and effectively. Such foam sheet material is dispensed and cut in varying defined lengths for use as packaging material for the wrapping and protecting of fragile objects, or to cushion objects during transportation.

The apparatus includes a pair of first and second retainer bars or jaws which are spaced apart from each other, so as to permit the sheet material to move therebetween along a defined directional flow path of the sheet material from the supply roll to the outlet of the apparatus. Typically, the sheet material is dispensed from a free-rolling supply roll on a fixed axis by a pair of tension rollers, with one roller being motor-driven to unroll the sheet material and move the sheet material, by tension against the surface of the sheet material, toward the outlet of the apparatus.

The first pair of sheet-retainer bars is fixed and laterally spaced apart, to define an air space therebetween of sufficient width to permit the passage of the cutting knife of the apparatus into the air spaced during the cutting operation, while the sheet material is retained taut or under tension in a fixed position between the first and second sheet-retainer bars in a sheet-retainer position. The pair of first and second sheet-retainer bars is spaced apart generally on opposite sides of the directional flow path of the sheet material on and in opposing relationship, so that the sheet material may move along the flow path therebetween while being dispensed.

The second pair of sheet-retainer bars is also laterally spaced apart a distance sufficient for the passage of the cutting knife therebetween, as the cutting knife moves between a sheet-cutting and a nonsheet-cutting position. The cutting knife or other means, to sever or cut the sheet material, is disposed with the second pair of movable, spring-tensioned sheet-retainer bars for reciprocating movement with a piston in a cylinder, the movement of the piston between a defined position controlled by control means by which the user can select the desired length of sheet material to be dispensed and cut. Where the width of the sheet material to be cut is wide, it is preferred that at least a pair of piston-cylinder arrangements be used connected by a swing-bar assembly or means for simultaneous movement and operation, to provide a rapid and accurate cut along the full width of the apparatus. The first and second sheet-retainer bars and the cutting knife generally extend across the full width of the sheet material. The control means provides for movement of the second pair of sheet-retainer bars and the cutting knife sequentially between a nonsheet-retaining, nonsheet-cutting position, wherein the sheet material may move freely along the directional flow path between the first and second sheet-retainer bars to the outlet being driven by the sheet-driving motor, and a sheet-retaining position, wherein the piston moves the second pair of sheet-retainer bars into contact against the one surface of the sheet material, so as to retain firmly the sheet material under tension between the first and second sheet-retainer bars and to hold the sheet material across the air space and across the top of the cutting knife in a taut or tensioned or nonslack sheet position, and later, generally momentarily thereafter, to move the piston with the cutting knife between the fixed second pair of sheet-retainer bars, to cut the retained, taut sheet material and to pass the sheet material into the free air space between the fixed, first pair of sheet-retainer bars, to provide effective, accurate cutting of the sheet material simultaneously across its width.

The control means then permits the piston and the pair of second sheet-retainer bars and the cutting knife to move once again to the nonsheet-retainer, nonsheet-cutting position. When the second pair of sheet-retainer bars and the cutting knife are removed from the directional flow path, the cut sheet is removed by the user and the sheet material is moved a predetermined length along the flow path, before further actuation of the piston by the control means occurs to repeat the sequential movements.

In the apparatus and method, the sheet material is retained in a fixed position laterally between the retainer bars at two fixed points or areas, and generally in a taut or nonslack position, to facilitate the easy and accurate cutting of the taut sheet material. Further, the apparatus and method provide that the cutting knife moves totally through the taut sheet material and into an air space on the opposite side and between the two spaced-apart, laterally fixed areas where the sheet is retained, thereby ensuring full and effective cutting of the sheet material across the entire sheet width. The apparatus and method may be used to cut and dispense a wide variety of sheet materials. The apparatus and method, by cutting into air, prevent the rapid dulling of the cutting or severing edge which may occur, where a cutting knife engages a solid surface. Further, by cutting the sheet material while the sheet material is under tension between two short distance points or areas; for example, 1 inch to 12 inches, the sheet material is not stretched or damaged in the cutting operation.

The apparatus and method of the invention will be described for the purpose of illustration only in connection with a particular embodiment; however, it is recognized that various changes, modifications, additions and improvements may be made by those persons skilled in the art, all falling within the spirit and scope of the invention.

DESCRIPTION OF THE EMBODIMENTS

Figure 1:
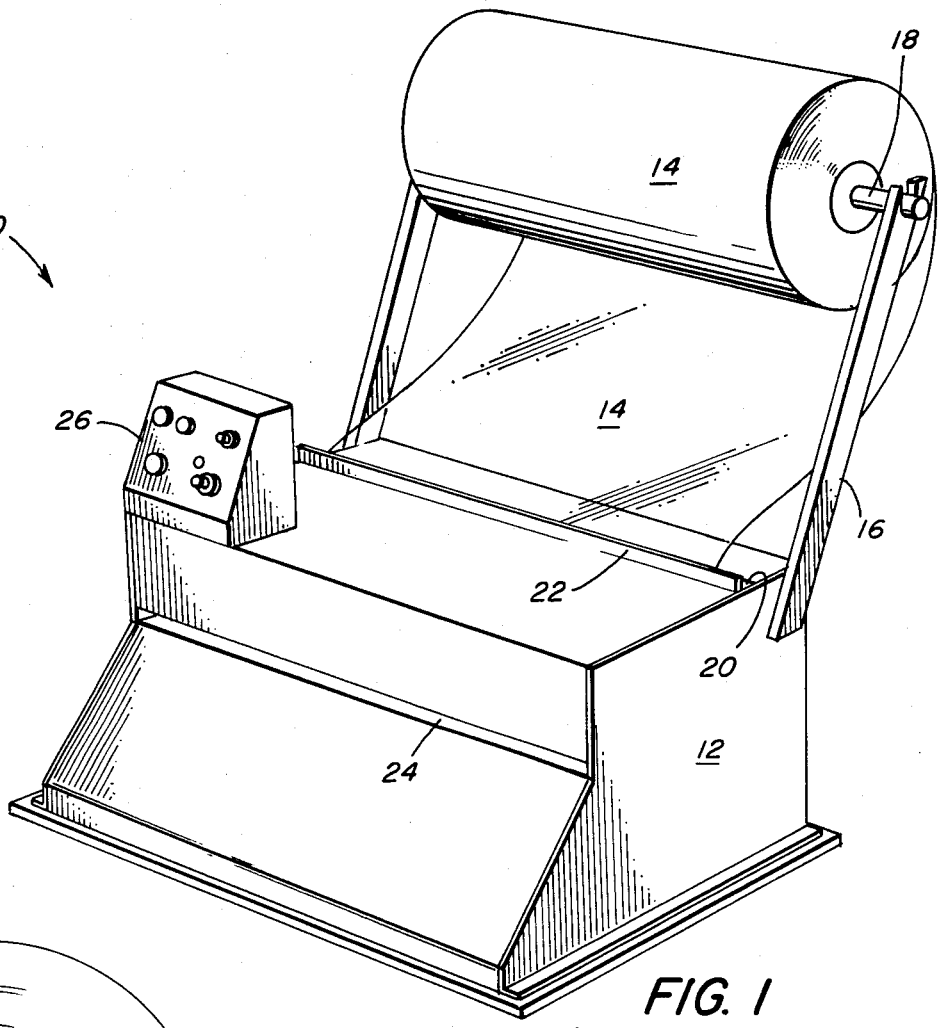
FIG. 1 is an illustrative, perspective view of the sheet-dispensing and -cutting apparatus of the invention.

With reference to FIG. 1, there is shown a dispensing and cutting apparatus 10 of the invention comprising a housing 12 and a roll of sheet material 14 to be dispensed and cut into the desired lengths, the sheet material comprising, for example, a flexible, polyethylene foam sheet material or a foam-bubble wrap material or the like suitable for use in packaging. The roll 14 is secured for free movement on a fixed roll axis 18 positioned on a roll-holding frame 16, with the sheet material 14 shown as being introduced downwardly into an entrance slot 20, which has a slightly raised guide bar 22 forward of the slot 20. The cut foam material is dispensed from the apparatus 10 through an exit slot 24. A control panel 26 contains an on/off switch, an on/off light and a cut-length selector knob, wherein the user may preselect the desired length of the sheet to be dispensed and cut, or where the length of the sheet to be cut may be varied.

Figure 2:
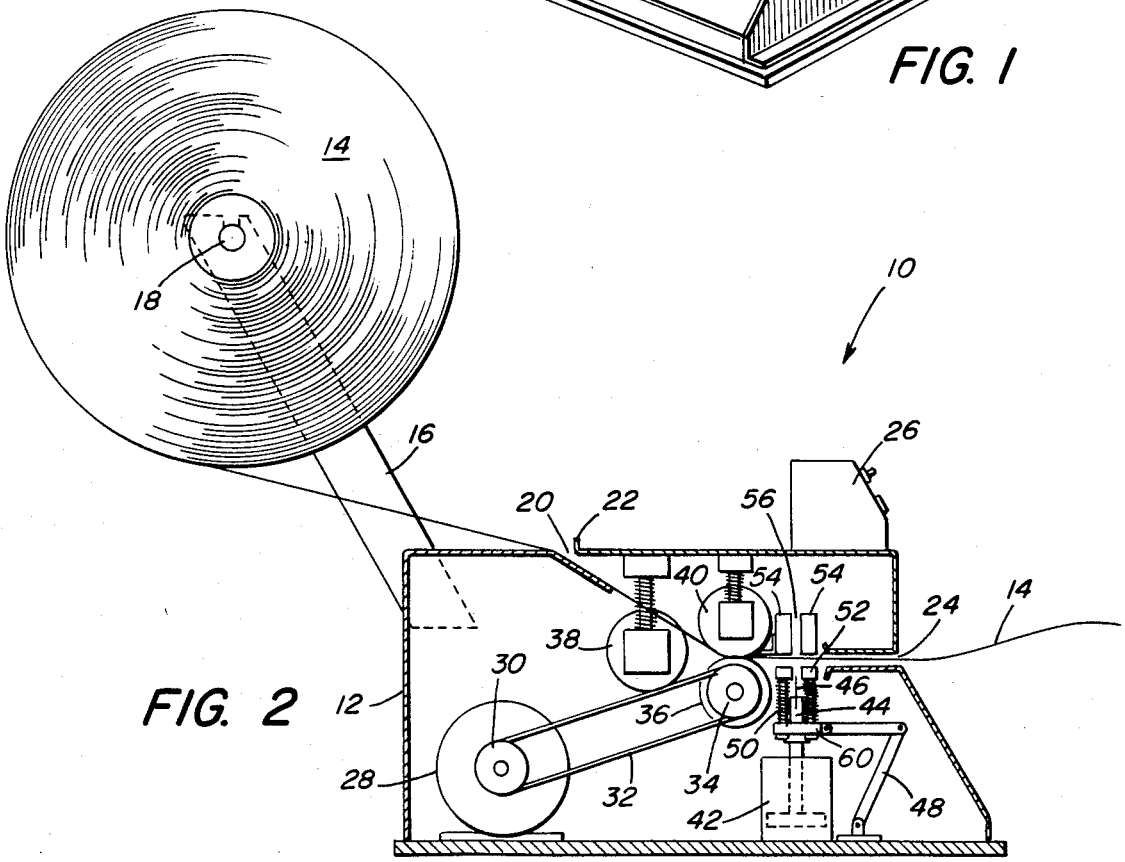
FIG. 2 is a side, sectional view of the apparatus of FIG. 1.
Figure 3:
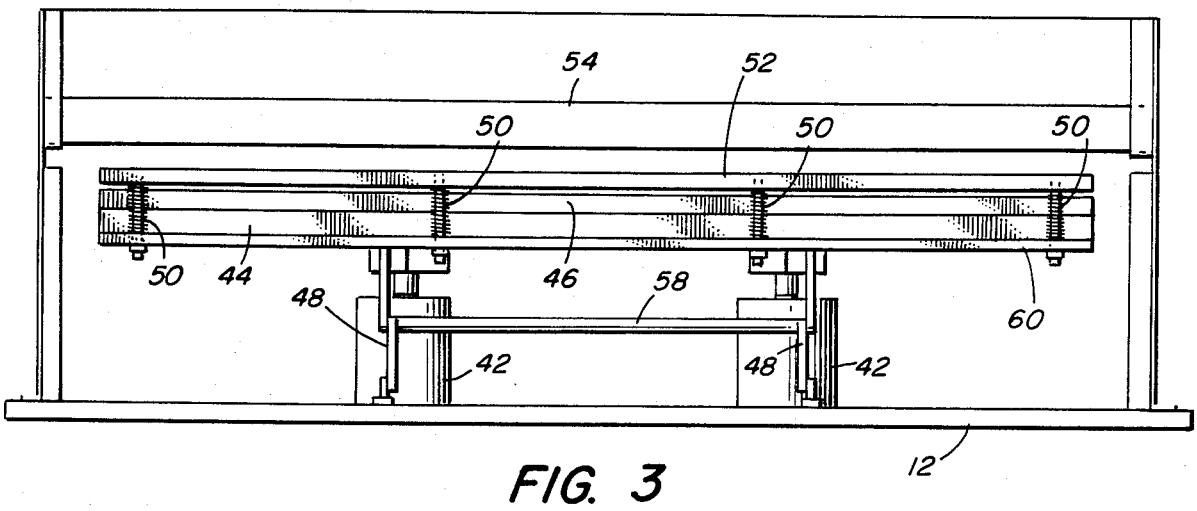
FIG. 3 is a front, sectional view of the apparatus of FIG. 1.

With particular reference to FIGS. 2 and 3, there is shown within the housing 12 a gear motor 28 with a sprocket drive 30, a driven chain 32 and a sprocket drive 34 mounted on a driven resilient roller 36, the roller contacting the underside of the foam sheet 14, to drive the foam sheet 14 forward through and along a predetermined directional flow path toward the exit slot 24. The apparatus 10 also contains a spring-loaded sprocket 38 in contact with chain 32, to maintain a desired chain tautness, and a spring-loaded pressure roller 40 positioned above the fixed, driven roller 36 and placed in contact with the upper surface of the sheet material, which, in conjunction with driven roller 36, acts to dispense the sheet material 14 through and along the predetermined flow path and out the exit 24.

The apparatus includes a pair of solenoid-operated air cylinders 42, each with a piston 44 which is actuated in a timed manner by air pressure, to move sequentially between a noncutting, nonsheet-retaining position and a noncutting sheet-retaining position and a cutting sheet-retaining position. The piston 44 has an elongated cutting blade 46 with an upwardly extending edge extending at least the width of the sheet material to be cut, mounted and secured on the head of the piston 44 for movement therewith, the edge of the cutting blade adapted to cut or sever the sheet material 14. A base plate 60 is secured to the lower section of the piston 44 for movement therewith, while a pair of laterally spaced-apart, parallel, elongated sheet-retainer bars 52, defining an air space 56 laterally therebetween for the passage of the cutting blade 46, is supported by spring-loaded and tensioned, upwardly extending rods 50 from the base plate 60, the rods threaded at the one end with threaded nuts thereon and having a coiled spring 62 about the rods 50 between the base plate 60 and the bars 52. A pair of supported, fixed, sheet-retainer, elongated bars 54 is disposed opposite to and spaced apart from the bars 52, to define a space therebetween for the directional movement of the sheet material 14. The fixed bars 54 are characterized by an air space therebetween, to permit the upward cutting movement of the edge of the cutting blade 46 to move therebetween, when in the sheet-cutting position. A swing-arm, pivoting assembly 48, with a connecting rod 58 therebetween, is connected to base plate 60, to provide for the general simultaneous movement of the movable bars 52 and the cutting blade 46 between the pair of cylinders and pistons employed. The swing-arm assembly 48 and rod 58 coordinate the movement, so that the sheet is retained and cut generally evenly across the entire width of the sheet material 14, on upward movement of the pistons 44.

Figures 4A, 4B, 4C:
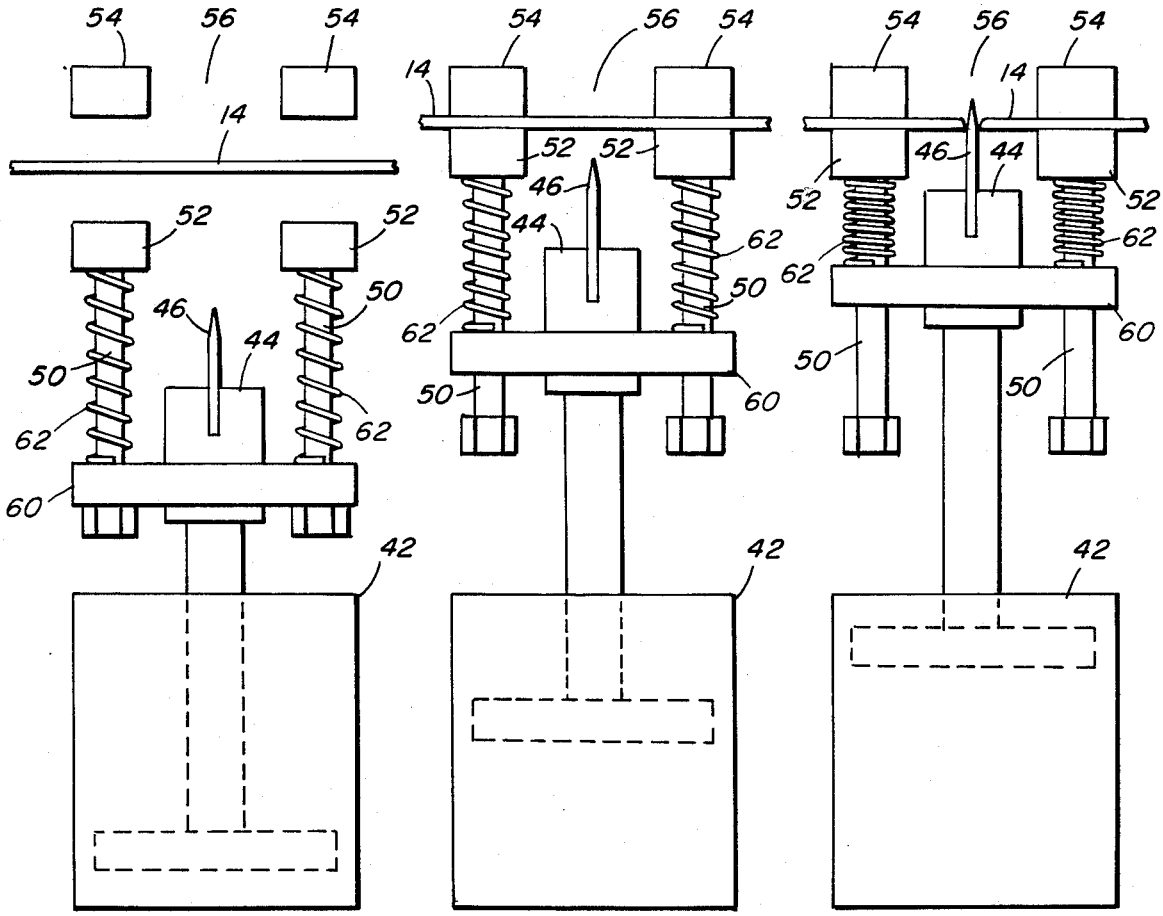
FIGS. 4(*a*), (*b*) and (*c*) are enlarged, fragmentary, sequential operation views of portions of the apparatus of FIG. 1.

FIGS. 4(*a*), (*b*) and (*c*) illustrate the sequential stages of movement of the sheet-retainer bars 52 and cutting blade 46. FIG. 4(*a*) illustrates, in a sectional, enlarged view, the piston 44 in cylinder 42 in a retracted position, wherein there is a free air space between the fixed and movable retainer bars 52 and 54 for the movement of the sheet material driven by gear motor 28 through the rollers 34 and 40 toward the exit 24. In the nonsheet-cutting and nonsheet-retaining position, both the bars 52 and the cutting blade 46 are positioned below the directional path of the sheet material. FIG. 4(*b*) illustrates the sheet-noncutting and sheet-retaining position, wherein the piston 44 has been actuated to move the bars 52 upwardly, to retain the sheet material firmly between the fixed retainer bars 54 and the retainer bars 52, but with the cutting blade 46 still below the retained sheet material. In the position illustrated in FIG. 4(*b*), the retainer bars 52 are under tension from the coiled spring 62 about the rods 50, and the upper and lower bars 52 and 54 firmly grip the sheet material therebetween in a taut condition between the respective pair of bars. The fixed rods 50 slide through the base plate 60, as the piston 44 is moved into the sheet-retaining position.

FIG. 4(*c*) illustrates the sheet-cutting and sheet-retaining position, wherein the piston 44 has moved further upwardly, to permit the cutting edge of the cutting blade 46 to cut through the tautly retained sheet material 14 firmly held by the opposing retainer bars 52 and 54 in position for cutting. In this cutting position, the cutting blade 46 has cut the sheet material and has moved into the air space 56 between the pair of retainer bars 54, to provide for a positive, effective cutting action across the entire width of the sheet material. This arrangement avoids difficulties wherein the cutting blade is not wholly aligned, and ensures cutting across the entire width. As illustrated, the upward movement of the piston 44 further compresses the coil spring 62, so that the sheet material is firmly gripped and retained, while the cutting blade cuts the sheet material. After the cutting operation, the piston 44 is returned to the position of FIG. 4(*a*), while the cut sheet material is removed from outlet 24, and the sheet material is then driven to the next position for cutting.

Figure 6A:
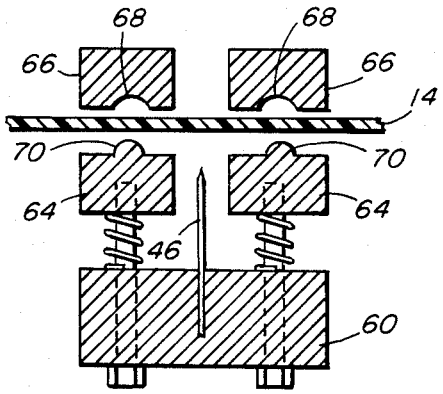
FIGS. 6(*a*) and (*b*) represent enlarged, fragmentary, sectional views and operations of a modification of the retaining-bar assembly of the apparatus of FIG. 1.
Figure 6B:
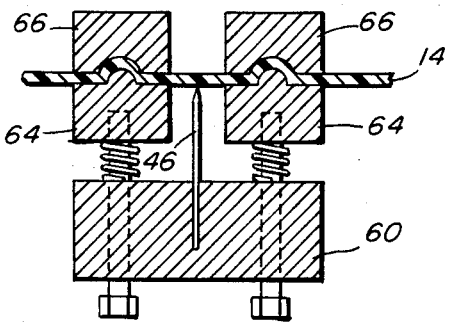

FIG. 6 illustrates a modification in the shape of the retainer-bar surfaces, so that, instead of being generally flat surfaces, which may be rough or knurled, to help retain the sheet material, the modified retainer bars 64 and 66 define an elongated, raised surface ridge 70 on lower movable bar 64 and a mating cavity 68 on the opposing fixed bar 66. In this modification, the upward movement of the bar 68 firmly retains the sheet material 14 between the raised ridge 70 and the cavity 68 and stretches the sheet material between the bars 64 and 66 to a highly taut or tensioned position, so that cutting blade 46, on upward movement, may cut easily the highly taut sheet material. This modification is particularly useful for relatively thick, resilient or foam sheet material or sheet material difficult to cut without being under tension, or for sheet material which has a surface with a low coefficient of friction, so that the material is not firmly or easily gripped with flat surface bars.

Figure 5:
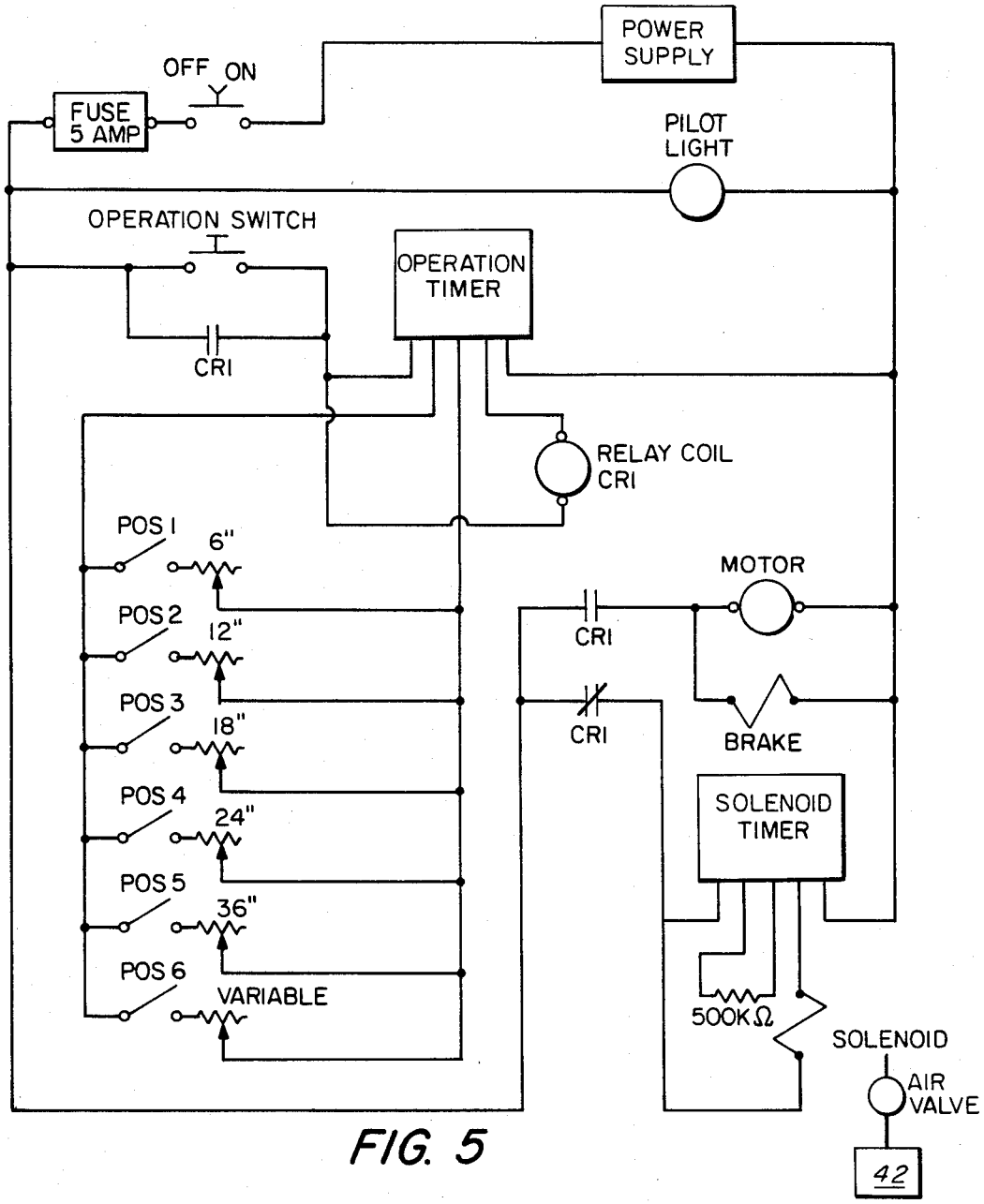
FIG. 5 is a schematic, electrical-circuit, control diagram for the control of the apparatus of FIG. 1.

FIG. 5 illustrates an electrical-circuit diagram used as the control means 26 for the apparatus, wherein the electrical circuit is connected to a power supply; for example, 110 v 60 amps. The diagram shows an on/off switch for the control means and a pilot light to indicate and signal its operation, and an operation switch connected through an open relay CR1 to a solid-state, resistance capacitor, operation timer which is connected to a rotary-type operation rheostat knob having six positions illustrated by POS 1–6 and to a relay coil of CR1. The timer provides, with the different resistance of the rheostats selected, time delays which determine the particular length of the sheet material 14 to be dispensed by control of the motor 28 connected by open relay CR1 and a motor brake, which brake acts to stop the drive motor on a timed basis, depending on the sheet length to be dispensed. The diagram includes a solid-state, resistance capacitor timer as a solenoid timer, which solenoid timer is connected to and operates the bar and knife electrical solenoid valve, to provide for operation of the piston 44 to its varying positions in a controlled, timed manner. The electrical solenoid valve is connected to a multiple part; for example, a four-way air valve, which is connected to the air cylinder 42 which operates piston 44.

In operation, the main power supply is turned on by the on/off switch which lights up the pilot light. Actuation of the operation switch, after selection of the desired sheet material length by movement of the rheostat knob to a selected position, actuates the motor which drives the sheet material, until the operation timer for the selected length time stops, which deenergizes the open CR1 relay and deenergizes the motor 28 and actuates the driving motor brake. On stopping of the motor and actuation of the motor brake, the solenoid timer is then actuated by a preset time through the bar and knife solenoid, which operates the four-way air valve to air cylinder 42 in a timed, selective manner. The air valve has two operation positions and two exhaust positions to move the piston 44 and the retainer bar 52 upwardly to the nonsheet-cutting, sheet-retaining position and then to move the knife blade 46 into the sheet-cutting position, to cut the retained sheet material 14. The solenoid timer has a time delay dwell after the cutting operation; for example, ½ to 2 seconds, to permit the piston 44 and knife blade 46 to return with the retainer bars to the noncutting, nonsheet-retaining position, so that operation may be repeated by the operation of the operation switch. In a typical operation, the dispensing of a 6-inch length of sheet material would operate on a time of 1 to 2 seconds, the sheet retained for ½ to 1 second for cutting, and ½ to 1 second for return of the knife blade and retainer bars to the original position, to permit movement of the sheet material 14 for the next dispensing and cutting operation.

The apparatus and method described provide for the rapid, effective and easy dispensing and positive cutting across the width of a variety of sheet materials.

What is claimed is:

1. A sheet-cutting and -dispensing apparatus, which apparatus comprises:

(a) support means to support a source of sheet material to be dispensed and cut by the apparatus;

(b) drive means to move the sheet material from the support means along a predetermined, directional flow path toward an outlet, where the cut sheet material is to be dispensed;

(c) a first pair of laterally spaced-apart, sheet-retainer means characterized by an air space therebetween and positioned adjacent the directional flow path of the sheet material;

(d) a second movable pair of laterally spaced-apart, sheet-retainer means aligned generally opposite the first pair of retainer means and on the opposite side of the directional flow path of the sheet material, to define a sheet-movement space between the first and second retainer means for the directional flow movement of the sheet material, when the first and second retainer means are in a nonsheet-retaining position;

(e) a cylinder means including a piston for reciprocating movement;

(f) a sheet-cutting means secured for reciprocating movement with the piston between a sheet-cutting and a -noncutting position and positioned between the second retainer means;

(g) the second retainer means secured for reciprocating movement with the piston between a sheet-retaining position, wherein the first and second retainer means retain the sheet material in a fixed, generally taut condition therebetween, and a nonsheet-retaining position, wherein the sheet material is free to move in the sheet-movement space and to move along the directional flow path;

(h) control means to provide for the reciprocating movement of the piston between (i) a nonsheet-retaining position, whereby the sheet material may move along the directional flow path from the means to support to the outlet, (ii) a sheet-retaining position, whereby the first and second retainer means are positioned to retain the sheet material therebetween in a taut condition across the air space, and (iii) a sheet-cutting and -retaining position, whereby the cutting means cuts the taut, retained sheet material and moves into the air space, the control means providing for the dispensing of a desired amount of sheet material by the drive means, and the preselected, timed, sequential control of the piston between the noncutting and retaining position, the sheet-retaining position and the sheet-cutting position.

2. The apparatus of claim 1 wherein the first sheet-retainer means comprises a pair of fixed, elongated, generally parallel, spaced-apart retainer bar elements extending at least the width of the sheet material to be cut.

3. The apparatus of claim 1 wherein the second sheet-retainer means comprises a pair of movable, elongated, generally parallel, spaced-apart retainer bar elements extending at least the width of the sheet material to be cut.

4. The apparatus of claim 1 wherein the sheet-cutting means comprises an elongated cutting knife blade having a cutting edge directly secured to the piston and positioned generally intermediate the pair of second sheet-retainer means, with the knife edge positioned slightly spaced apart from the retained sheet material, when the sheet material is in the noncutting, but sheet-retaining, position.

5. The apparatus of claim 1 which includes a plurality of cylinder means and pistons and a plurality of pivotable swing-arm assembly means secured to each piston for movement therewith, and with a connecting means between the swing-arm assembly means, to provide for the general simultaneous movement, across the width of the sheet material, of the plurality of pistons between the respective piston positions.

6. The apparatus of claim 1 wherein the pair of first and second sheet-retainer means is characterized by contoured surfaces thereof, so that, in the sheet-retaining position, the sheet material is retained in a firm, tensioned condition for cutting between the pair of first and second sheet-retainer means.

7. The apparatus of claim 1 wherein the apparatus includes:

(a) a base-plate element secured to the piston for movement therewith;

(b) a pair of rod elements extending from and through the base plate;

(c) a pair of second sheet-retainer means which comprises generally parallel retainer bar elements secured at the one end of the rod elements; and (d) coiled spring elements about the rod elements, to provide tension to the second sheet-retainer bar elements, whereby, on movement of the piston and base plate and the second sheet-retainer bars to the sheet-retainer position and the cutting means to the sheet-cutting position, the second sheet-retainer bar elements retain the sheet elements under spring tension.

8. The apparatus of claim 1 wherein the drive means includes:

(a) a drive motor actuated for defined periods of time by the control means, to dispense the desired length of sheet material prior to cutting the sheet material; and (b) a pair of rollers, one of the rollers driven by the drive motor and the other roller being in a tensioned position adjacent thereto, with the sheet material passing through the pair of rollers, whereby the sheet material is driven along the directional flow path toward the outlet.

9. The apparatus of claim 1 wherein the control means includes:

(a) an electric solenoid;

(b) a first timing means to operate in a defined, timed manner the electric solenoid;

(c) a fluid valve means operated by the electric solenoid;

(d) a cylinder means comprising a fluid-operated cylinder and piston in fluid communication with the valve means, to drive the sequential piston between the nonsheet-retaining, sheet-retaining and sheet-cutting positions in a timed manner by the timed operation of the electric solenoid;

(e) second timing means to control the timed operation of the drive means; and (f) variable resistance means in electrical communication with the second timing means, to provide for the timed operation of the drive means to dispense the preselected length of sheet material to be dispensed, prior to cutting the dispensed sheet material by the timed operation of the electric solenoid.

10. The apparatus of claim 1 which includes a supply roll of sheet material to be cut and dispensed, the supply roll supported for removal on the support means.

11. A sheet-cutting and -dispensing apparatus, which apparatus comprises:

(a) a support means to support a roll of sheet material to be cut and dispensed by the apparatus;

(b) a housing having an inlet for the introduction of sheet material and an outlet for the dispensing of cut sheet material which includes (i) a drive motor and a pair of rollers, one of which is driven by the drive motor, the sheet material adapted to pass between the rollers and to be driven along a predetermined directional flow path between the inlet and the outlet, (ii) a first pair of laterally spaced-apart, elongated, sheet-retainer bar elements fixed to the housing and characterized by an air space between the bar elements, and positioned adjacent the directional flow path of the sheet material, (iii) a second pair of laterally spaced-apart, spring-tensioned, elongated, sheet-retainer bar elements positioned adjacent the directional flow path of the sheet material and disposed on the opposite side and generally aligned with the first pair of sheet-retainer bar elements, to define a sheet material movement space therebetween for the directional flow movement of the sheet material, when the first and second sheet-retainer bar elements are in the nonsheet-retaining position, (iv) an elongated cutting blade positioned between the second sheet-retainer bar elements, (v) a plurality of fluid-actuated cylinder means, each containing a piston, the cylinder means disposed generally uniformly across the width of the sheet material to be cut, the piston adapted for reciprocating movement, (vi) swing-arm assembly means connected to each of the pistons, to provide for generally simultaneous, parallel movement of the pistons together, (vii) the second sheet-retainer bar elements and the cutting blade secured for movement with each of the pistons, (c) control means to provide for the predetermined, timed actuation of the drive motor, to dispense sheet material of the desired length, and for the predetermined, sequential actuation of the pistons between (i) a nonsheet-retaining position, wherein the sheet material may be driven by the drive motor along the directional flow path toward the outlet, (ii) a sheet-retaining position wherein the movement of the piston places the first and second retainer bar elements in a sheet-retaining position, whereby the sheet is retained in a firm, generally taut condition between the pairs of bar elements, and (iii) a sheet-cutting position wherein the further movement of the piston forces the cutting blade through the taut sheet material and into the said air space.

12. The apparatus of claim 11 wherein the surfaces of the first and second sheet-retainer bar elements are matingly contoured, so that, in the sheet-retaining position, the sheet material retained is stretched to a tensioned condition between the laterally spaced bar elements in the directional flow path.

13. The apparatus of claim 11 wherein the apparatus includes:

(a) an elongated base-plate element secured to each of the pistons for movement therewith; and (b) a plurality of rod spring-biased elements secured at one end to the elongated, second sheet-retainer bar elements and passing at the one end through the base-plate element, to provide for spring-tension against the sheet material, when the second sheet-retainer bar elements are in the sheet-retainer position.

* * * * *